US008573141B2

(12) United States Patent
Peterman

(10) Patent No.: US 8,573,141 B2
(45) Date of Patent: Nov. 5, 2013

(54) REVERSIBLE JAMB BLOCKS AND METHOD OF USING THE SAME

(75) Inventor: John M. Peterman, Weldon Spring, MO (US)

(73) Assignee: Gillespie + Powers, Inc., St. Louis, MO (US)

( * ) Notice: Subject to any disclaimer, the term of this patent is extended or adjusted under 35 U.S.C. 154(b) by 242 days.

(21) Appl. No.: 13/156,560

(22) Filed: Jun. 9, 2011

(65) Prior Publication Data

US 2011/0303136 A1 Dec. 15, 2011

Related U.S. Application Data

(60) Provisional application No. 61/353,354, filed on Jun. 10, 2010.

(51) Int. Cl.
*F27D 1/04* (2006.01)

(52) U.S. Cl.
USPC ..... 110/338; 110/336; 110/181; 110/172; 110/339; 110/173 R; 373/71; 432/247; 432/250; 432/252

(58) Field of Classification Search
USPC ..... 110/172, 173 R, 341, 181, 336–339; 373/71; 52/574, 173.1, 396.01; 432/247, 250, 252; 49/347, 247, 250, 49/252
See application file for complete search history.

(56) References Cited

U.S. PATENT DOCUMENTS

| | | | | |
|---|---|---|---|---|
| 76,280 | A | 3/1868 | Whelpley et al. | |
| 428,953 | A * | 5/1890 | Riddel | 202/248 |
| 1,085,859 | A * | 2/1914 | Gallagher | 110/182 |
| 1,452,583 | A * | 4/1923 | Williams | 52/575 |
| 1,483,978 | A * | 2/1924 | Keenan | 110/173 R |
| 1,768,732 | A * | 7/1930 | Beall | 52/506.03 |
| 2,781,747 | A | 2/1957 | Braun | |
| 3,315,430 | A * | 4/1967 | Reynolds et al. | 52/599 |
| 4,041,670 | A * | 8/1977 | Kaplan | 52/592.2 |
| 4,200,499 | A | 4/1980 | Gerding | |
| 4,400,240 | A | 8/1983 | Abendroth | |
| 4,429,641 | A | 2/1984 | Early | |
| 4,445,849 | A | 5/1984 | Bouille | |
| 4,977,838 | A * | 12/1990 | Farrell et al. | 110/173 R |
| 5,727,479 | A * | 3/1998 | McAfee et al. | 110/176 |
| 6,298,632 | B1 * | 10/2001 | Sherwood | 52/745.1 |
| 7,661,239 | B2 * | 2/2010 | Price | 52/605 |
| 8,176,702 | B2 * | 5/2012 | Adam | 52/575 |
| 2003/0009970 | A1 * | 1/2003 | MacDonald et al. | 52/562 |
| 2008/0245005 | A1 * | 10/2008 | Fennell | 52/223.7 |
| 2010/0118910 | A1 * | 5/2010 | Nosbisch | 373/71 |

* cited by examiner

*Primary Examiner* — Kenneth Rinehart
*Assistant Examiner* — Sharla Magana
(74) *Attorney, Agent, or Firm* — Polster, Lieder, Woodruff & Lucchesi, L.C.

(57) ABSTRACT

A reversible jamb block for a furnace, oven or kiln, having an attachment side adapted to removably attach to the first side of a doorway for the furnace, oven or kiln, and adapted to removably attach to the second side of the doorway, such that one face of the jamb block is directed away from the furnace when the attachment side of the jamb block is attached to the first side of the doorway, and a second face opposite the first face, is directed away from the furnace when the attachment side of the jamb block is attached to the second side of the doorway.

21 Claims, 4 Drawing Sheets

REVERSIBLE JAMB BLOCKS AND METHOD OF USING THE SAME

CROSS REFERENCE TO RELATED APPLICATIONS

This application derives and claims priority from U.S. provisional application 61/353,354 filed 10 Jun. 2010, which application is incorporated herein by reference.

STATEMENT REGARDING FEDERALLY SPONSORED RESEARCH OR DEVELOPMENT

Not applicable.

BACKGROUND OF THE INVENTION

This invention relates principally to a high temperature oven, furnace or kiln, and more particularly to a unique reversible jamb block for the sides of a door for a high temperature oven, furnace or kiln.

When a high temperature oven, furnace or kiln is constructed, the device will typically incorporate one or more doors to allow access to various areas within the body of the oven, furnace or kiln. In most cases, the door will be constructed of steel or some other rigid and temperature resistant metal, and may have refractory material or some other high temperature insulation material attached to or surrounding the metal to provide additional heat resistance. Such doors fit into specially configured door frames designed to receive the doors and minimize the amount of heat that may escape between the door and the door frame.

However, high temperature oven, furnace or kiln doors and door frames are exposed to very harsh environmental conditions. They must retain integrity at very high temperatures while in the presence of various gases that may include highly volatile and caustic chemical such as, for example, oxygen, carbon and sulfur compounds, and various forms and combinations of grit. In addition, such doors are typically very heavy and unwieldy, and it is therefore not uncommon for the operation of the doors to impart substantial vibration, shock and impact loads on the doors and the door frames. As a result, the doors and door frames degrade and must be replaced on a regular basis. It is desirable, therefore, that the door frames be built to withstand such abuses while providing a reasonable cycle lifetime.

One common component of such door frames is a replaceable door jamb block. These replaceable jamb blocks are vertical pillars positioned on each side of the door frame against which the edges of the door rests when closed. Traditionally, the doors and door frames are constructed of heavy materials such as steels and ceramics, and are configured such that the door rests at an angle against the door frame with the upper end of the door leaning inward towards the body of the oven, furnace or kiln. The traditional replaceable jamb blocks, in turn, comprise an outward directed face that is sloped to receive the edges of the door in a flush manner. Anchor bolts are used to secure the jamb blocks to the side of the opening in the doorway. The traditional replaceable jamb blocks are, therefore, trapezoidal in shape.

The outside faces of the traditional jamb blocks wear out due to several factors. Impact damage from service equipment, door movement abrasions, and door impact. The movement of the door is two fold. First, the door moves vertically against the doorway and abrades the jamb block surfaces. Second, the door moves in and out against the doorway and impacts the jamb block surfaces. Often, the door is suspended and atop the jamb blocks and acts as a heavy and abrasive pendulum during the operation of the kiln.

In contrast, the inside faces of the jamb blocks are protected from the conditions that damage the front faces, because the inside faces are traditionally encased in and protected by the refractory walls of the kiln. In addition, expansion material, normally a high temperature crushable block refractory, is often used to separate the kiln's inside refractory wall from the inside face of the jamb blocks. This allows the kiln's refractory walls to expand toward the jamb blocks without damage to the inner face of the jamb blocks.

Nonetheless, once the front faces of traditional jamb blocks degrade to an unacceptable level, the blocks must be replaced. It is desirable, therefore, to devise a jamb block that has a longer service life than traditional configurations.

As will become evident in this disclosure, the present invention provides benefits over the existing art.

BRIEF DESCRIPTION OF THE DRAWINGS

The illustrative embodiments of the present invention are shown in the following drawings which form a part of the specification.

Corresponding reference characters indicate corresponding parts throughout the several views of the drawings.

DETAILED DESCRIPTION

Figure 1:
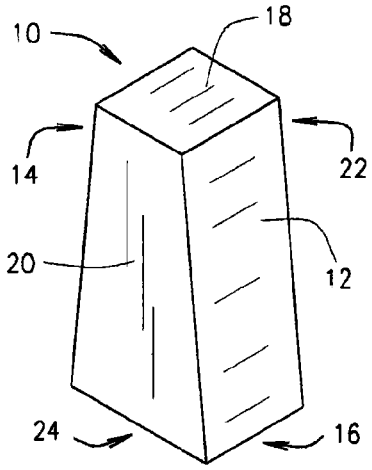
FIG. 1 is a perspective view of a reversible jamb block incorporating one embodiment of the present invention.

In referring to the drawings, an embodiment of the novel reversible jamb block 10 for a furnace, oven or kiln (collectively hereinafter "kiln") of the present invention is shown generally in FIGS. 1-4, where the present invention is depicted by way of example. As can be seen, the jamb block 10 has a flat first face 12, a flat second face 14 opposite the first face 12, a flat base 16 and a flat top 18 opposite and parallel to the base 16. The jamb block 10 further has a flat first attachment side 20 and a flat second attachment side 22 opposite and substantially parallel to the first side 20. When viewed from either of the first or second sides 20 or 22, the perimeter of the jamb block 10 forms an isosceles trapezoid. The jamb block 10 has a body 24 defined by the faces 12 and 14, the base 16, the top 18 and the first and second attachment sides 20 and 22. The jamb block 10 is symmetrical about a vertical center plane 30 (FIG. 2) that bisects the jamb block 10.

The body 24 of the jamb block 10 is comprised of a material that is rigid, and composed to withstand exposure to the high and low temperature extremes and hostile gaseous and particulate environment found at the doorway of a kiln. The particular material that may be used is somewhat dependent upon the specific application. However, such material is typically one or more of a variety of refractory ceramics. The jamb block material must also be strong and durable enough to withstand the repeated opening and closing of a heavy metal door.

Figure 2:
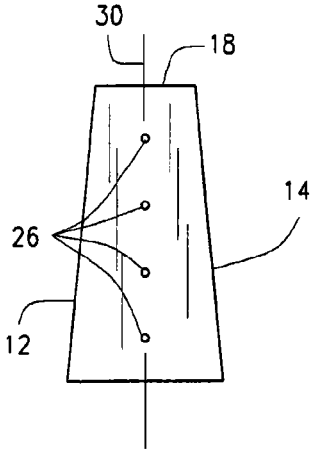
FIG. 2 is a side view of the reversible jamb block of FIG. 1.
Figure 3:
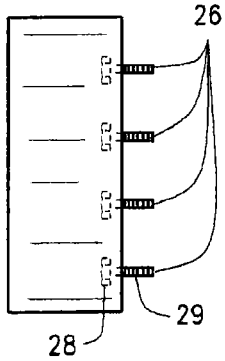
FIG. 3 is an edge view of the reversible jamb block of FIG. 1.
Figure 4:
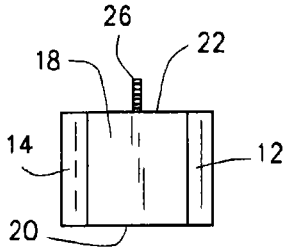
FIG. 4 is a top view of the reversible jamb block of FIG. 1.
Figure 6:
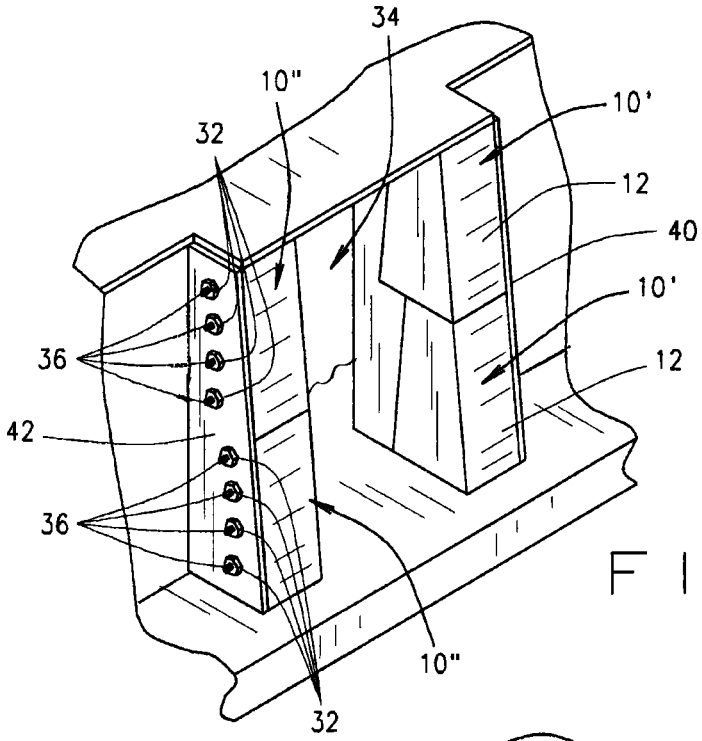
FIG. 6 is a perspective view of the four reversible jamb blocks of FIG. 5 arranged in pairs in a stacked configuration and attached to the sides of a kiln doorway.
Figure 7:
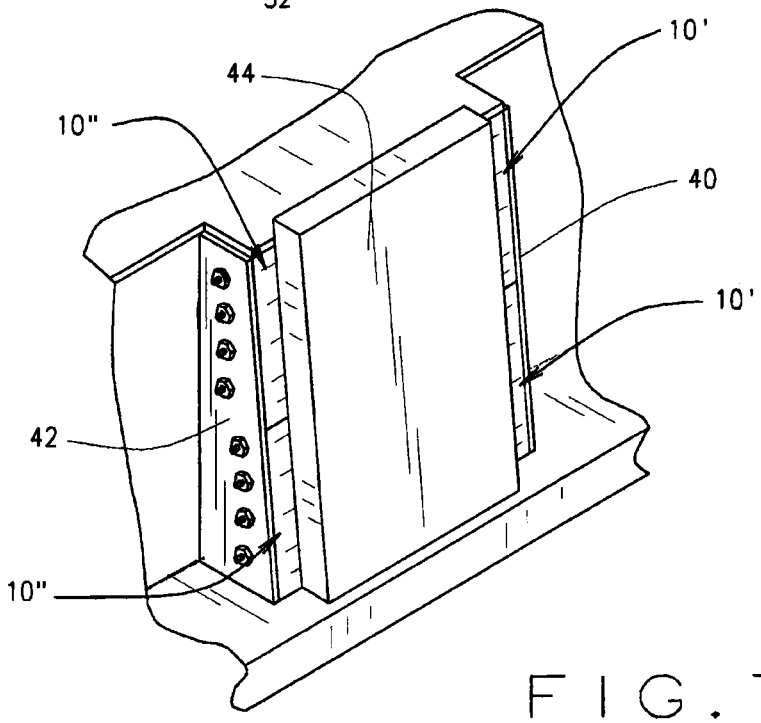
FIG. 7 is a perspective view of the four reversible jamb blocks of FIG. 5 arranged in pairs in a stacked configuration and attached to the sides of a kiln doorway, with a kiln door positioned against the front face of the jamb blocks.

The jamb block 10 also comprises four steel anchor bolts 26, each having a hexagonal head 28 and a threaded end 29. (FIGS. 2, 3, 4). The anchor bolts 26 are imbedded headfirst in the body 24 of the jamb block 10 through the second attachment side 22 and are all equidistant from one another along the plane 30. The heads 28 are held fast in the body 24 and the treaded ends 29 protrude out of the body 24 perpendicular to the second attachment side 22. In this way, the anchor bolts 26 are unable to rotate in the body 24. The anchor bolts 26 are positioned to mate with and penetrate matching anchor bolt holes 32 (see FIG. 6) along right and left metal side plates 40 and 42 of a doorway 34 for a kiln so that nuts 36 sized to fit the threaded ends 29 of the anchor bolts 26 can be used to secure the jamb block to the side plates 40 and 42 of the doorway 34. A door 44 (see FIG. 7) can be positioned against the outward facing faces of the jamb blocks 10' and 10". The door 44 may be placed in the doorway 34 in a variety of ways, including for example, manually, with rollers, using springs, using guides, on hinges, or any of a variety of other ways well known to one of ordinary skill in the art. Often times, a door 44 will be held in place with pressure from a weight or a biasing mechanism (not shown).

Figure 8:
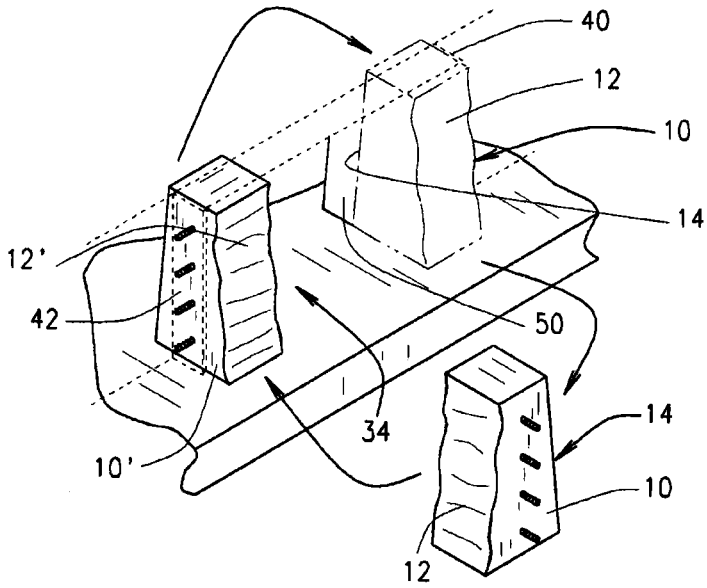
FIG. 8 is a perspective view of a pair of the reversible jamb blocks of FIG. 1 arranged in a doorway of a kiln, and depicting the reversible attribute of the jamb block.
Figure 9:
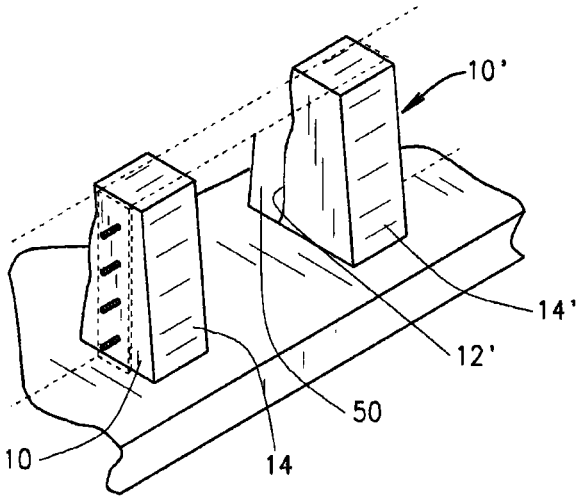
FIG. 9 is a perspective view of the reversible jamb blocks of FIG. 8 arranged in the kiln doorway after having been reversed.

Referring now to FIGS. 8 and 9, and as can be appreciated by one of ordinary skill in the art, when initially installed in a doorway 34 for a kiln, a pair of the novel jamb blocks 10 and 10' may be secured to the doorway 34 with the first of the jamb blocks 10 secured to the right side plate 40 and the opposite jamb block 10' secured to the left side plate 42 as shown. In this way, the first faces 12 and 12' of the blocks 10 and 10' are directed outward and away from the kiln. The opposing faces 14 and 14' are thereby directed toward the kiln where they mate with and are protected by the inner wall 50 of the kiln. When the first faces 12 and 12' of the jamb blocks 10 and 10' reach an unacceptable degree of degradation, as depicted in FIGS. 8 and 9, or are otherwise damaged or in need of replacement, the jamb block 10 can be removed from the right side of the kiln doorway 34, rotated 180 degrees about its central vertical axis, and secured to the left side of the kiln doorway 34 with the face 12 directed toward the kiln inner wall 50 and the face 14 directed away from the kiln. At the same time, the jamb block 10' can be removed from the left side of the kiln doorway 34, rotated 180 degrees about its central vertical axis, and secured to the right side of the kiln doorway 34 with the face 12' directed toward the kiln inner wall 50 and the with the face 14' directed away from the kiln. The blocks 10 and 10' may then be secured to the doorway 34 with the nuts 36 as previously discussed. In this way, and as shown in FIG. 9, the degraded faces 12 and 12' are now directed toward or into the kiln doorway 34, and the fresh and undamaged faces 14 and 14' are now directed away from the kiln doorway, and ready to receive the door 44.

Of course, alternatively, the jamb block 10 may initially be secured to the left side plate 42 with the face 14 directed outward and away from the inner wall 50, and the jamb block 10' will then initially be secured to the right side plate 40 with the face 14' directed outward and away from the inner wall 50. In this instance, when jamb block replacement is desired, the jamb block 10 is removed from the left side plate 42 of the kiln doorway 34, rotated 180 degrees about its central vertical axis, and secured to the right side plate 40 of the kiln doorway 34 with the first face 12 directed outward and away from the kiln inner wall 50, while the jamb block 10' is removed from the right side plate 40 of the kiln doorway 34, rotated 180 degrees about its central vertical axis, and secured to the left side plate 42 of the kiln doorway 34 with the first face 12' directed outward and away from the kiln inner wall 50.

Hence, the novel configuration of the current inventive jamb block 10 may provide approximately twice the service life of a traditional jamb block. In addition, only a single configuration of jamb block 10 is required for each kiln doorway, instead of conventional designs that require a different jamb block for each side of the doorway 34.

Figure 5:
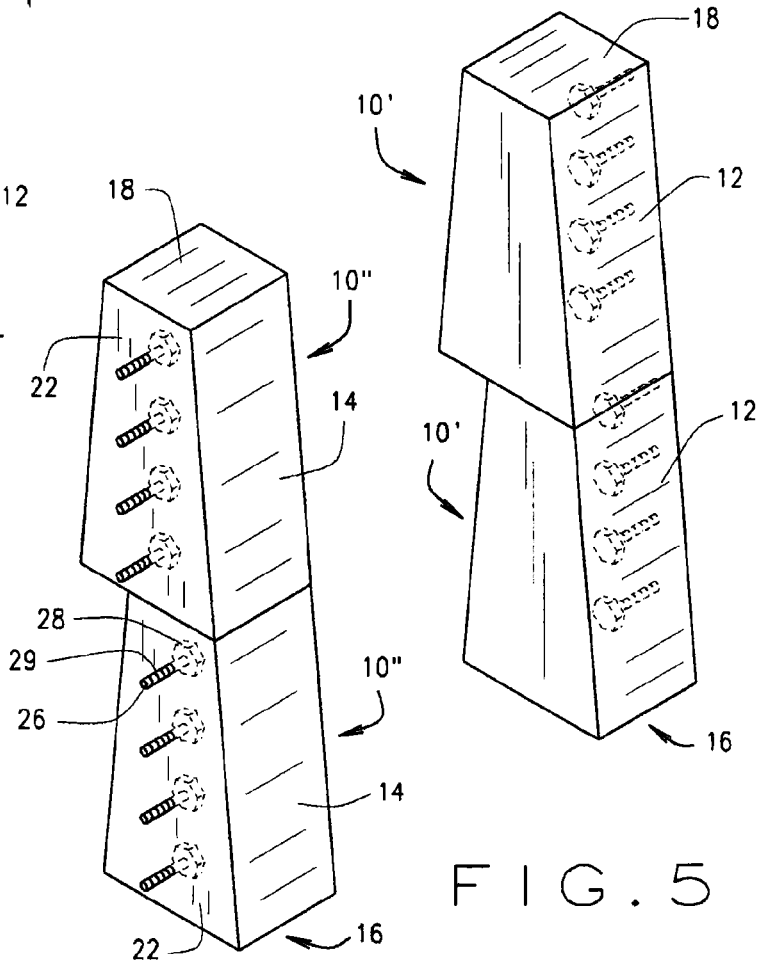
FIG. 5 is a perspective view of four reversible jamb blocks of FIG. 1 arranged in pairs in a stacked configuration for attachment to both sides of a kiln doorway.

Moreover, the novel jamb block 10 is configured so that it may be stacked in a vertical manner to accommodate kiln doorways of varying heights. In the example shown in FIG. 5, two sets of paired jamb blocks 10' and 10" are arranged such that two of the jamb blocks 10' are positioned with anchor bolts 26 facing to the right and the other two of the jamb blocks 10" are positioned with anchor bolts 26 facing to the left. The right side jamb blocks 10' are arranged with one of the jamb blocks 10' stacked atop the other such that the base 16 of the upper jamb block 10' rests atop the top 18 of the lower jamb block 10', and the first faces 12 of both jamb blocks 10' are coplanar. In this way, the first faces 12 of the jamb blocks 10' are both directed away from the kiln, and present a single sloped surface to receive the right side of the door 44 to the kiln. Likewise, the left side jamb blocks 10" are arranged with one of the jamb blocks 10" stacked atop the other such that the base 16 of the upper jamb block 10" rests atop the top 18 of the lower jamb block 10", and the second faces 14 of both jamb blocks 10" are coplanar. In this way, the second faces 14 of the jamb blocks 10" are both directed away from the kiln, and present a single sloped surface to receive the left side of the door 44 to the kiln.

Figure 10:
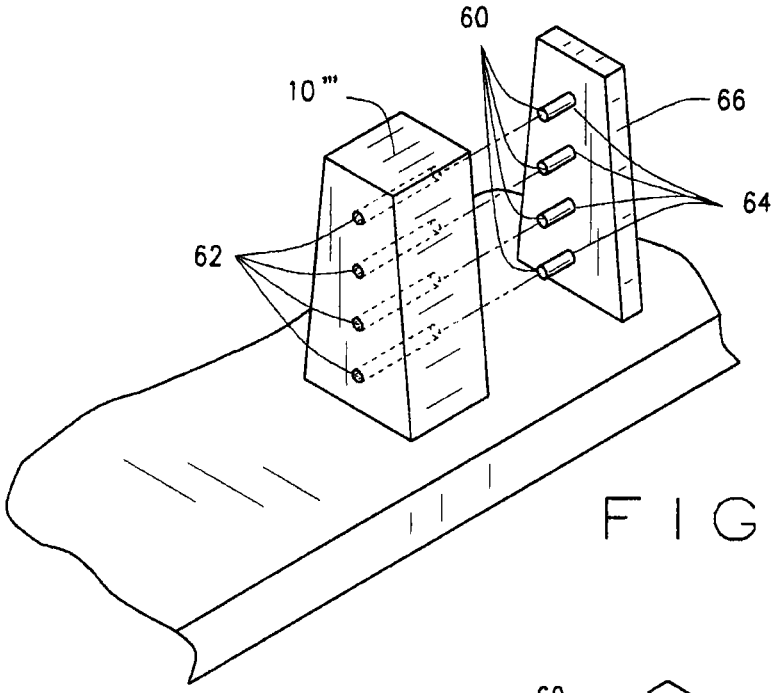
FIG. 10 is a perspective view of an alternate configuration of the reversible jamb block of the present invention, depicting the interface between the jamb block and the pegged side plate of a kiln doorway.
Figure 11:
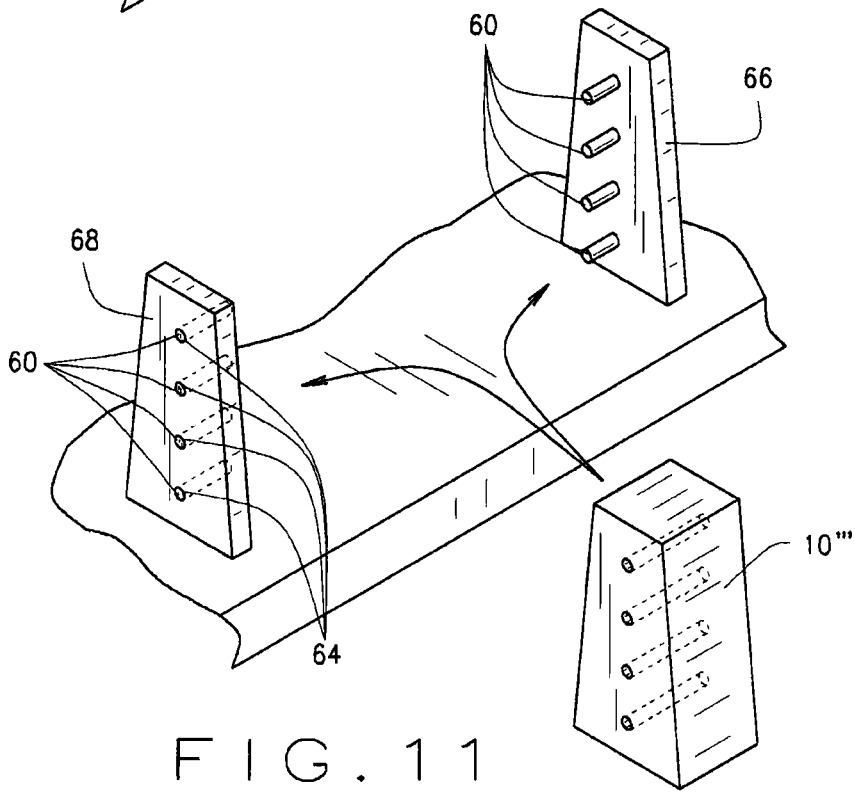
FIG. 11 is a perspective view of the reversible jamb block of FIG. 10 in relation to two opposing pegged side plates of a kiln doorway, depicting the reversible attribute of the jamb block.

In yet another embodiment (FIGS. 10, 11), the novel jamb block 10''' may alternatively be configured with removable anchor bolts or pegs 60 that are configured to fit into matching bores 62 in the block 10''' and simultaneously into matching bores 64 of a side plate 66 of the doorway 34. As can be appreciated, the novel jamb block 10''' can be readily secured to the side plate 66 using the bolts or pegs 50 for alignment and retention. Thereafter, the block 10''' can readily be removed, rotated 180 degrees about its central vertical axis, and placed back against the side plate 66 or placed against the side plate 68 on the other side of the doorway 34 (FIG. 11). Alternatively, the bolts or pegs 60 could be fixed in place in the side plates 66 and 68.

While I have described in the detailed description several configurations that may be encompassed within the disclosed embodiments of this invention, numerous other alternative configurations, that would now be apparent to one of ordinary skill in the art, may be designed and constructed within the bounds of my invention as set forth in the claims. Moreover, each of the above-described novel reversible jamb blocks 10, 10', 10" and 10''' of the present invention can be arranged in a number of other and related varieties of configurations without expanding beyond the scope of my invention as set forth in the claims.

For example, instead of anchor bolts 26, the jamb block 10 may alternately comprise any of a variety of attachment devices such as for example, hooks, screws, latches, clamps, pegs, pins, etc., so long as the attachment devices adequately secure the jamb block 10 to the kiln doorway as needed for the particular application. Further, the blocks 10 are not restricted to using any particular number of the bolts 26, but may use as many or as few as may be required to adequately secure the blocks 10 to the doorway 34. In addition, the bolts 26 can be arranged in patterns other than a single row along the central plane 30, so long as the block 10 can be rotated about a vertical axis such that the bolts 26 can mate to reciprocal bores 32 on the opposing side of the doorway 34. Moreover, the body 24 of the jamb block 10 may be configured to engage the kiln doorway such that the anchor bolts 26 may be unnecessary. This engagement may be interlocking, such as for example a tongue and groove configuration.

With regard to stacking, the jamb blocks 10, 10' and 10" may be of a variety of heights, widths and thicknesses in order to accommodate a myriad of configurations of kiln doorways. Further, the jamb blocks 10, 10' and 10" may be configured to stack more than two high.

Additional variations or modifications to the configuration of the novel reversible jamb block 10 of the present invention may occur to those skilled in the art upon reviewing the subject matter of this invention. Such variations, if within the spirit of this disclosure, are intended to be encompassed within the scope of this invention. The description of the embodiments as set forth herein, and as shown in the drawings, is provided for illustrative purposes only and, unless otherwise expressly set forth, is not intended to limit the scope of the claims, which set forth the metes and bounds of my invention.

What is claimed is:

1. A furnace doorway comprising:

a. a frame having a first side and a second side opposite the first side with a top spanning therebetween, the first side of the frame having a first set of a plurality of first attachment elements arranged symmetrically about a first vertical axis of symmetry positioned on the first side and a second set of a plurality of first attachment elements arranged symmetrically about a second vertical axis of symmetry positioned on the first side, said first and second vertical axes of symmetry being non-collinear; and b. a plurality of jamb blocks, each jamb block comprising a first attachment side and a second attachment side opposite the first, both attachment sides configured to adjoin the first side of the frame, both attachment sides having at least two second attachment elements arranged to correspond to two of the first attachment elements of at least one of the sets of first attachment elements on the first side of the frame, each of said corresponding first and second attachment elements configured to releasably attach to each other, such that either of the block attachment sides can be releasably attached to the same set of first attachment elements of the first side of the frame.

2. The furnace doorway of claim 1, wherein each attachment side has a vertical axis of symmetry and the corresponding second attachment elements on each attachment side are arranged symmetrically about said attachment side's vertical axis of symmetry.

3. The furnace doorway of claim 1, wherein at least one of said first attachment elements comprises one of a recess and a protrusion and its corresponding second attachment element comprises the other of the one of a recess and a protrusion, the recess configured and positioned to receive the protrusion.

4. The furnace doorway of claim 3, wherein the recess defines a bore.

5. The furnace doorway of claim 4, wherein the protrusion comprises a pin.

6. The furnace doorway of claim 5, wherein pin comprises a bolt.

7. The furnace doorway of claim 6, wherein the recess defines a cylindrical throughbore with a diameter, the bolt having a head larger than the throughbore diameter, the bolt further having a shank with a threaded end opposite the head, the throughbore being sized to receive the shank, the shank having sufficient length for the nut to be secured to the threaded end after the shank is extended through and the head is abutting the throughbore.

8. The furnace doorway of claim 1, further comprising a third attachment element positioned between at least one of said first attachment elements and its corresponding second attachment element, and wherein the first and second and third attachment elements releasably attach together.

9. The furnace doorway of claim 8, wherein the third attachment element comprises a pin.

10. The furnace doorway of claim 9, wherein the at least one of said first attachment elements and its corresponding second attachment element both comprise a recess, the recess configured and positioned to receive the pin.

11. The furnace doorway of claim 10, wherein the recess defines a bore.

12. The furnace doorway of claim 1, wherein at least two sets of the first attachment elements and at least a first and a second of said plurality of jamb blocks are configured such that one of said jamb blocks stacks atop the other of said jamb blocks when the jamb blocks are releasably attached to said first and second sets of first attachment elements.

13. The furnace doorway of claim 12, wherein said first and second of said plurality of jamb blocks each have a vertical axis and a substantially planar first face between the attachment sides that share a common slope relative to their respective vertical axes, and wherein said first and second jamb blocks and said first and second sets of first attachment elements are configured such that the two first faces are substantially coplanar when said first and second sets of the first attachment elements and the second attachment elements of said first and corresponding second of said plurality of jamb blocks are attached to one another.

14. The furnace doorway of claim 13, wherein said vertical axes comprise axes of symmetry and the corresponding second attachment elements on each attachment side of each of said first and second jamb blocks are arranged symmetrically about said attachment side's vertical axis of symmetry.

15. The furnace doorway of claim 14, wherein each of said first and second jamb blocks further comprise a second face mirroring said jamb block's first face about said jamb block's vertical axis of symmetry.

16. The furnace doorway of claim 14, wherein both sides of said first and second jamb blocks is configured in the shape of a trapezoid.

17. The furnace doorway of claim 1, wherein both attachment sides of at least one of said plurality of first and second jamb blocks are configured in the shape of a trapezoid.

18. The furnace doorway of claim 1, wherein the second side of the frame has a third set of a plurality of first attachment elements arranged symmetrically about a third vertical axis of symmetry positioned on the second side and a fourth set of a plurality of first attachment elements arranged symmetrically about a fourth vertical axis of symmetry positioned on the first side, said third and fourth vertical axes of symmetry being non-collinear.

19. The furnace doorway of claim 18, wherein at least one of said first and second sets of first attachment elements of the first side of the frame and least one of said third and fourth sets of first attachment elements of the second side of the frame and at least one of said plurality of jamb bocks are collectively configured such that at least one attachment side of the jamb block can be releasably attached to any of the first, second, third or fourth set of first attachment elements.

20. The furnace doorway of claim 19, wherein both attachment sides of the at least one jamb block are configured such that at both said attachment sides can be releasably attached to any of the first, second, third or fourth set of first attachment elements.

21. The furnace doorway of claim 1, further comprising a door configured to at least in part close the doorway and rest at least in part against one or more of the plurality of jamb blocks when said one or more jamb blocks are positioned on the door frame with their second attachment elements attached to corresponding first attachment elements.

* * * * *